US006110016A

United States Patent [19]

Coleman et al.

[11] Patent Number: 6,110,016

[45] Date of Patent: Aug. 29, 2000

[54] LENS BLOCK AND METHOD OF PROCESSING LENSES

[75] Inventors: Charles R. Coleman, Pittsburgh; John E. Smarto, Trafford, both of Pa.

[73] Assignee: PPG Industries Ohio, Inc., Cleveland, Ohio

[21] Appl. No.: 09/102,324

[22] Filed: Jun. 22, 1998

[51] Int. Cl.[7] ..... B24B 1/00

[52] U.S. Cl. ..... 451/42; 451/460; 451/390

[58] Field of Search ..... 451/42, 43, 460, 451/384, 390

[56] References Cited

U.S. PATENT DOCUMENTS

| | | | |
|---|---|---|---|
| Re. 31,897 | 5/1985 | Johnson . | |
| 2,352,616 | 7/1944 | Canning . | |
| 2,509,211 | 5/1950 | Clement . | |
| 3,015,196 | 1/1962 | Campbell . | |
| 3,049,766 | 8/1962 | Buckminster . | |
| 3,140,568 | 7/1964 | Beasley | 51/216 |
| 3,192,676 | 7/1965 | Buckminster . | |
| 3,271,912 | 9/1966 | Buckminster | 51/216 |
| 3,448,549 | 6/1969 | McCall | 51/284 |
| 3,451,177 | 6/1969 | Buckminster et al. . | |
| 3,468,366 | 9/1969 | Suddarth . | |
| 3,499,253 | 3/1970 | McCall | 51/277 |
| 3,507,076 | 4/1970 | Rudd et al. . | |
| 3,663,983 | 5/1972 | Bole . | |
| 3,704,558 | 12/1972 | Sarofeen . | |
| 3,994,101 | 11/1976 | Coburn et al. | 51/216 |
| 4,118,898 | 10/1978 | Godot | 51/216 LP |
| 4,149,344 | 4/1979 | Keane, Jr. . | |
| 4,158,273 | 6/1979 | Olsen et al. | 51/284 R |
| 4,287,013 | 9/1981 | Ronning . | |
| 5,421,771 | 6/1995 | Wardle | 451/390 |
| 5,462,475 | 10/1995 | Kennedy . | |
| 5,520,568 | 5/1996 | Craighead et al. . | |
| 5,669,807 | 9/1997 | Moreau et al. . | |

*Primary Examiner*—Timothy V. Eley
*Assistant Examiner*—Dung Van Nguyen
*Attorney, Agent, or Firm*—William C. Mitchell

[57] ABSTRACT

A two-piece lens block allows for the rotation of an edged lens blank in order to align the cylinder of the lens blank correctly. The lens block includes a substantially cylindrical base having a first surface facing the lens blank and an opposed second surface with a plurality of driving recesses extending into the base from the second surface. A ring member surrounds the base and includes a mounting surface generally adjacent to the lens blank. The ring member is rotatable relative to the base prior to the attachment of the lens blank to the lens block. An edged lens-shaped cavity is provided in the ring member and provides for nearly full surface contact of an attachment alloy with a front surface of the lens blank to alleviate distortion. The two-piece lens block allows edged lens blanks to be surfaced to finished lenses.

20 Claims, 3 Drawing Sheets

LENS BLOCK AND METHOD OF PROCESSING LENSES

BACKGROUND OF THE INVENTION

1. Field of the Invention

The present invention relates to ophthalmic lens processing and, more particularly, to lens blocks for mounting ophthalmic edged lens blanks.

2. Background Information

Eyeglasses commonly utilize lenses having convex outer surfaces and concave inner surfaces. The two surfaces of each lens have different curvatures to obtain the desired optical refraction for the lens. For many lenses, the inner surface is in the shape of a section of a torus. The direction along which the longer radius is generated is referred to as the cylinder axis of the lens. These lenses are produced from a circular glass or plastic lens blank which is subjected to multiple stages of cutting and polishing on the surfaces. A lens holding chuck, or lens block, is adhered to the convex outer surface of the circular lens blank, otherwise known as blocking by techniques known in the art, to prepare the lens blank for surfacing. See for example, FIG. 1 of U.S. Pat. No. 5,520,568 and the disclosure associated with that figure (particularly, columns 1–3), which are incorporated herein by reference in their entirety.

The process of adhering the convex outer surface of the lens blank to the lens block generally involves placing tape, such as the tape described in U.S. Pat. No. 4,287,013, to said outer surface, e.g., the finished face of a semi-finished lens blank. The lens/tape subassembly is attached to the block by using a low melting temperature alloy. For example, one typical alloy having a melting point of approximately 117° F. (47.2° C.) and comprising 45% bismuth, 23% lead, 8% tin, 5% cadmium and 19% indium can be used. That alloy is injected in liquid form between the block and the tape and conforms to the convex face of the lens blank.

Presently, it is common to maintain the mounted lens blank on the lens block throughout the surfacing process to avoid the remounting of the lens blank on the lens block.

Earlier lens shaping techniques would remove and remount the lens blank on the lens block at various stages of surface processing. A principal problem in reattaching the lens blank to the lens block is the proper alignment of the optical center of the lens blank with the center point and cylinder axis of the lens block. See, for example, the lens blocks shown in U.S. Pat. Nos. 2,352,616; 2,545,447; 3,015,196; 3,049,766; 3,192,676; and 4,149,344. Following the surfacing of the lens blank, the lens/tape subassembly is removed from the lens block by methods known in the art and the protective tape removed, usually by manually peeling it off the surface. Thereafter, the peripheral edge of the circular blank is cut to the final frame or lens shape, which is also known as edging. In this step, the lens is attached to an edging block by holding mechanisms known in the art, e.g., U.S. Reissue Pat. No. 31,897, and the peripheral edge machined to the desired shape for the selected frame.

The use of a low melt temperature alloy to attach the lens blank/protective tape subassembly to the lens block suffers from certain drawbacks. For example, the hot alloy can damage the lens, e.g., by cracking a glass lens or warping a plastic lens. It can also create thermal patterns on the convex outer surface of a plastic lens, which unless removed, are seen by the lens wearer as patterns of distortion. Generally, the adhesive or low melting temperature attachment alloy utilized to attach the lens block to the lens blank is carefully selected to minimize the foregoing drawbacks. Certain prior art lens blocks have caused uneven heating of a plastic lens blank, thereby resulting in the generation of thermal patterns in the lens. When the thermal patterns are near the edge, they can be removed from circular lens blanks in the subsequent edging operation. However, if the marking extends too far into the center of the circular lens blank, the thermal patterns cannot be removed in the edging operation.

Laminated lenses which include at least two layers of glass or plastic to form the lens have recently been described. The likelihood of having the distortion problem discussed above will increase in the case of a laminated lens, particularly where the convex lens section adjacent to the lens block is thin. Moreover, there is a tendency for the center of the laminated lens to be heated higher than the edges by the attachment alloy. Recently, electro-optical lenses such as electrochromic lenses have been described. These lenses may be a laminated lens assembly which includes an electrically activated section of one or more electrically activated layers between the outer lens layers. Each electrically activated layer is positioned between two electrically conductive layers, e.g., electroconductive metal oxide films. In the construction of the electro-optical lens, the conductive layers are insulated from each other to prevent a short circuit, and each conductive layer generally is provided with a separate lead or contact point for connection to the controlling electrical circuit. These leads or contact points can only be easily attached to the conductive layers after the lens has been edged to its final shape for the selected frame. Alternatively, direct contact to a bus bar (i.e., without leads) is possible.

In the case of an electrochromic laminated lens, surfacing of the lens typically occurs after the lens is assembled and the leads or contact points attached. Conventional lens blocks used with conventional lens blanks cannot be used with an edged non-surfaced electrochromic laminate lens, because the support area which has the greatest thermal gradient is generally within the vision area.

It is an object of the present invention to provide an efficient method for surfacing edged lens blanks by providing an improved lens block in which an edged lens blank may be readily and easily attached thereto in an appropriate aligned position. A further object of the present invention is to provide a lens block which would provide a sufficiently large contact area between an attachment material (e.g., a metal alloy, wax or thermoplastic organic material having an appropriate melting point) and the front surface of the edged lens blank to avoid patterns of thermal distortion. Yet another object of the present invention is to provide a lens block which is easy and economical to manufacture and use.

SUMMARY OF THE INVENTION

The above objects are achieved by a two-piece lens block according to the present invention. The lens block includes a substantially cylindrical base and a ring member surrounding the base. The base has a first surface generally facing an edged lens blank. The ring member includes a mounting surface generally adjacent to the edged lens blank and a lens-shaped cavity surrounded by the mounting surface. The lens-shaped cavity is generally adjacent to the edged lens blank and provides substantially full surface contact between an attachment material having an appropriate melting temperature and the edged lens blank to limit or avoid distortion in the edged lens blank. The attachment material may be a metal alloy, wax or thermoplastic organic. The ring member is rotatable relative to the base prior to the attachment of the edged lens blank to the lens block to allow for proper orientation of the edged lens blank.

The base includes a second surface opposed from the first surface, and the base may include a plurality of driving recesses extending into the base from the second surface. The base may be provided with an attachment supply hole extending from the second surface to the first surface thereof. The supply hole is adapted to permit an attachment material to be injected therethrough to attach the lens blank to the lens block.

A portion of the mounting surface of the ring member and a portion of the first surface of the base may be concave, generally conforming to the shape of the lens blank. The ring member may additionally include an appropriate number of locating pins extending from the mounting surface thereof and a plurality of slots extending to a peripheral edge of the ring member. The ring member may further include an annular wall opposed from the mounting surface substantially surrounding the base and an annular stop abutting against the first surface of the base.

A method of processing a lens blank according to the present invention includes the mounting of an edged lens blank on the lens block of the present invention in the proper alignment followed by surfacing of the edged blank to generate the appropriate optical qualities for the finished lens. The mounting of the edged lens blank includes placing the edged lens blank on the ring member adjacent the lens-shaped cavity, aligning the ring member and edged lens blank relative to the base, and attaching the lens blank, the ring member and the base together with suitable attachment material. Once the attachment material has cooled to solidify, the ring may optionally be removed leaving an attached base and lens block.

These and other objects of the present invention will be clarified in the description of the preferred embodiments which is described in connection with the attached figures wherein like reference numerals represent like elements throughout.

DESCRIPTION OF THE PREFERRED EMBODIMENTS

A lens block 10 according to the present invention is shown in FIGS. 1–6. The lens block 10 is for mounting of an edged lens blank 5, shown in FIGS. 5 and 6 in phantom, and includes a two-piece assembly which allows for the rotation of the edged lens blank 5 in order to locate the cylinder of the lens blank 5 correctly. The edged lens blank 5 may be an electro-optic lens, e.g., an electrochromic laminate lens assembly, with the leads attached. This assembly may comprise a laminate of a convex edged lens blank, an electroconductive layer, e.g., a conductive metal oxide layer, an electrochromic layer, an ion-conducting layer, a complementary electrochromic layer, a second electroconductive layer, and a concave edged lens blank. This lens assembly may comprise a semi-finished lens blank, e.g., it may be a single or multi-focal lens or other optical element. The lens block 10 can be formed out of aluminum, however, other appropriate materials may be utilized to construct the lens block 10.

Figure 1:
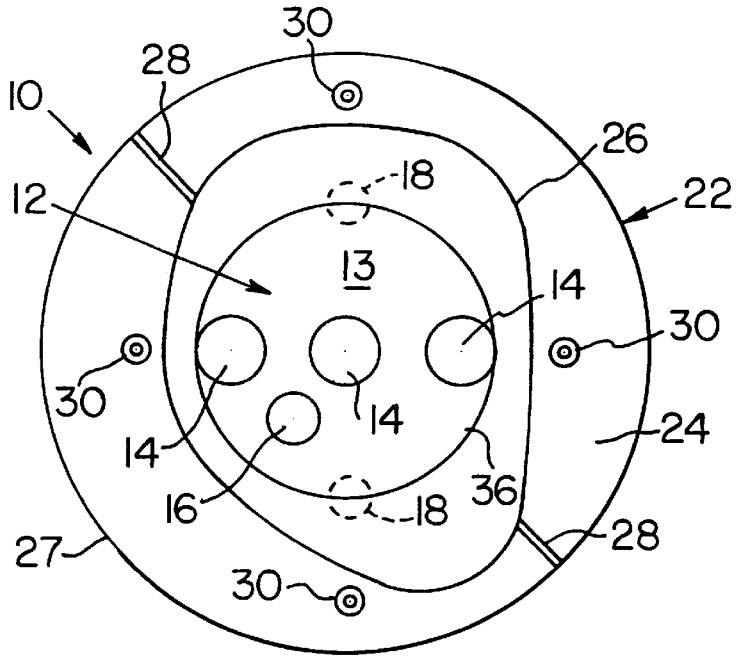
FIG. 1 is a top plan view of a lens block according to the present invention.
Figure 3:
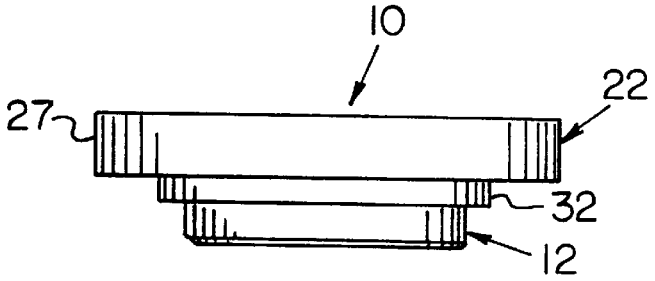
FIG. 3 is a side view of the lens block shown in FIG. 1.
Figure 2:
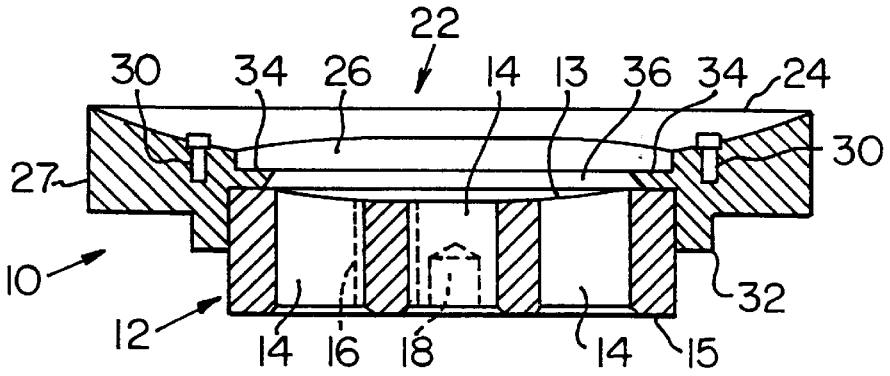
FIG. 2 is a sectional view of the lens block shown in FIG. 1.
Figure 4:
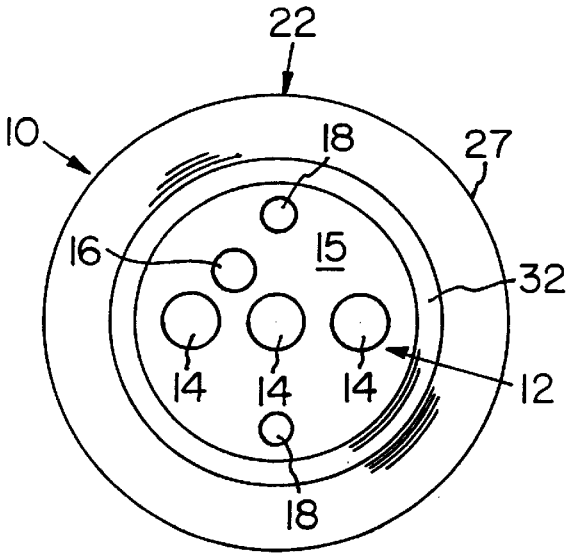
FIG. 4 is a bottom plan view of the lens block shown in FIG. 1.
Figure 5:
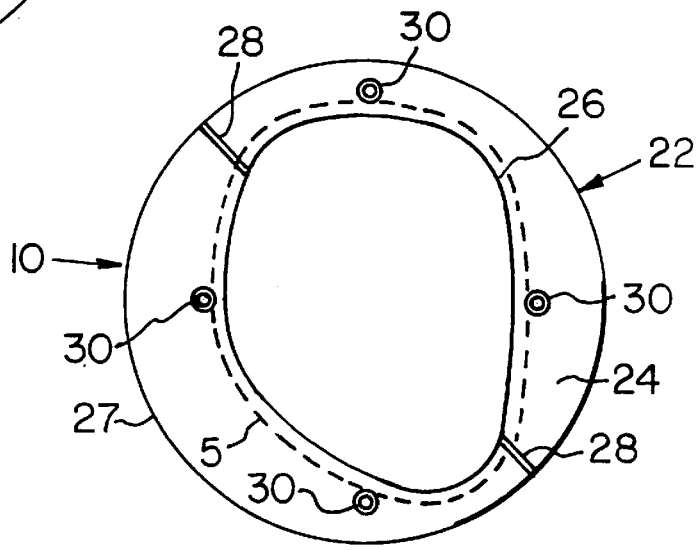
FIG. 5 is a top plan view of the lens block shown in FIG. 1 with an edged lens blank attached thereto.
Figure 6:
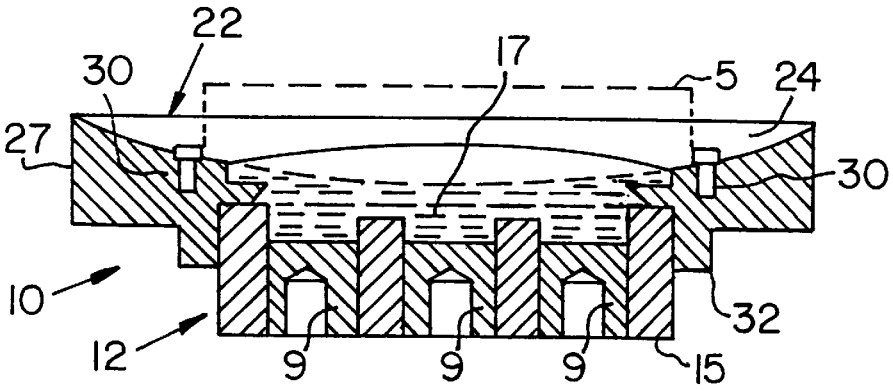
FIG. 6 is a sectional view of the lens block shown in FIG. 5.

The lens block 10 includes a substantially cylindrical base 12 with a generally concave first surface 13 generally facing the lens blank 5. The base 12 includes three driving recesses 14 extending therethrough from a second surface 15 opposed from the concave first surface 13 and extending to the concave first surface 13. As shown in FIGS. 1 and 4, the driving recesses 14 are along a diametrical line extending across the base 12. The driving recesses 14 may receive drive studs 9 therein, as shown in FIG. 6, for attachment to rotating spindles or drives of lens grinding and cutting machines as known in the art. The base 12 additionally includes supply hole 16 extending therethrough. The supply hole 16 is adapted to permit an attachment material 17, shown in FIG. 6, to be injected therethrough to attach the lens block 10 to the lens blanks 5. Appropriate attachment materials have a melting temperature of about 120° F., such as the lead-indium alloy described above. Other suitable attachment materials include wax or thermoplastic organic material. The base 12 additionally includes a pair of reference holes 18 extending into the base 12 from the second surface. As shown in FIGS. 1 and 2, the reference holes 18 do not extend all the way through the base 12 and stop short of the first surface 13.

A ring member 22 surrounds the base 12 and forms the second piece of the two-piece lens block 10. The ring member 22 has a concave mounting surface 24 which is generally adjacent to the edged lens blank 5. The mounting surface 24 of the ring member 22 surrounds a lens-shaped cavity 26 formed in the ring member 22. The lens-shaped cavity 26 is intended to be slightly smaller than the edged lens blank 5 and is shaped substantially similar thereto. The mounting surface 24 of the ring member 22 additionally includes a pair of diametrically opposed slots 28 each extending from the cavity 26 to a peripheral edge 27 of the ring member 22. The mounting surface 24 additionally may have two pairs of diametrically opposed locating pins 30 extending from the mounting surface 24. Each locating pin 30 is mounted in a pin hole extending into the ring member 22.

The ring member 22 includes an integral annular wall 32 which is opposed from the mounting surface 24 and which surrounds the base 12. An annular stop 34 of the ring member 22 is adjacent to cavity 26 and abuts against an outer, substantially planar portion of the first surface 13 of the base 12. The annular stop 34 surrounds an opening 36 which communicates with the cavity 26.

Another embodiment is envisioned without the annular stop 34 permitting removal of the ring portion after the attachment material is injected and cooled to a solid support in the shape of the lens.

Figure 7:
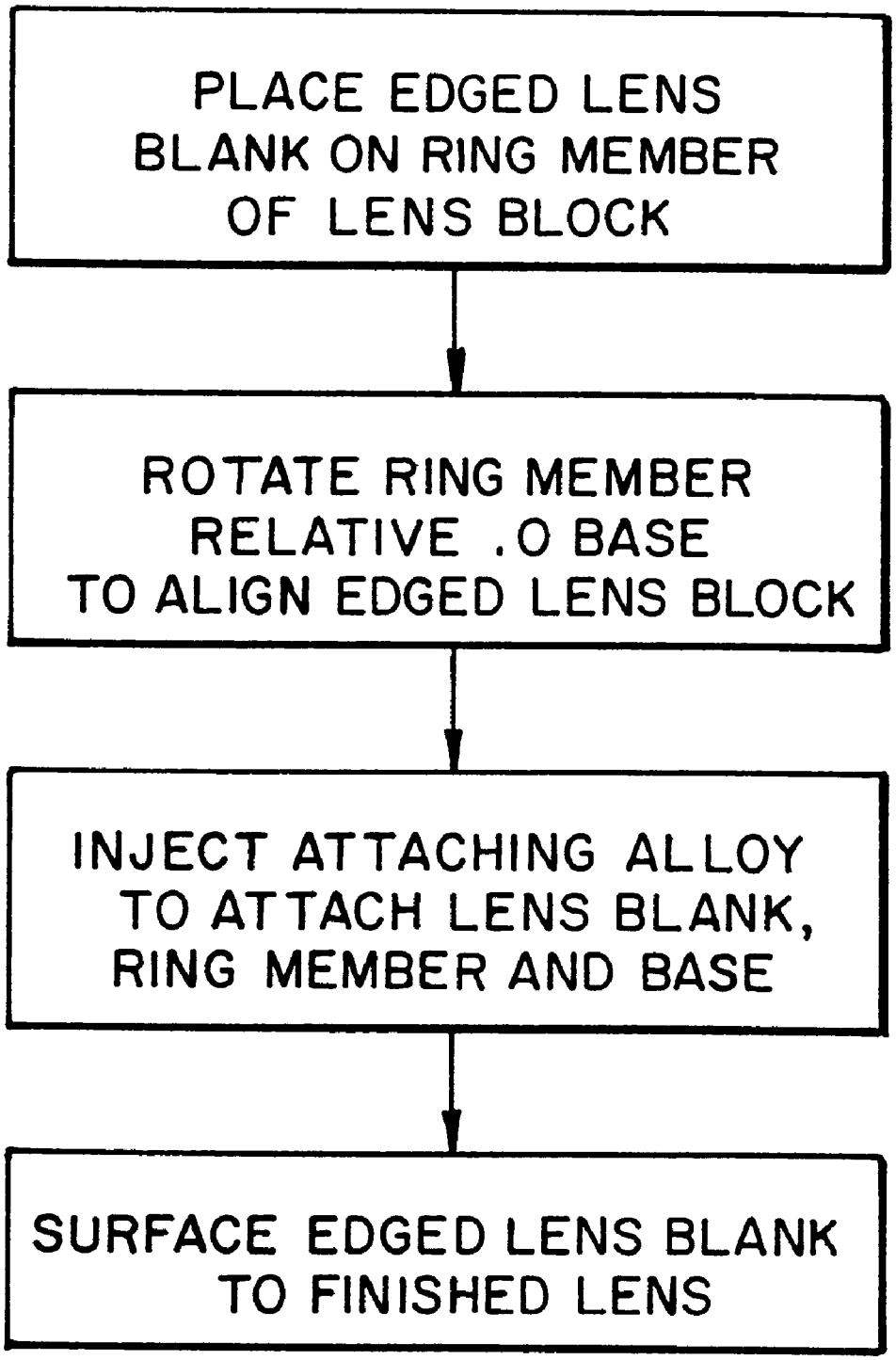
FIG. 7 is a schematic block illustration of the method of processing lenses according to the present invention.

In operation, which is shown schematically in FIG. 7, the edged lens blank 5 is placed on the ring member 22 within the locating pins 30 adjacent the cavity 26. The two-piece lens block 10 of the present invention allows the rotation of the ring member 22 and lens blank 5 relative to the base 12 to appropriately align the edged lens blank 5 prior to injection of the attachment material 17. The lens blank 5 must be aligned relative to the base 12 because it is already cut to shape, i.e., edged, and the cylinder to be cut into the lens blank 5 must be aligned properly in the final lens. Alignment is not an issue in the prior art using circular lens blanks since during surfacing these have not yet been edged. Alignment of the lens blank and the lens block becomes an issue where, as in the present invention, the lens blank 5 is edged prior to surfacing.

Following proper alignment, the attachment material 17 can be injected into the cavity 26 through supply hole 16 and through opening 36. When injected, the attachment material 17 is essentially a liquid, as shown in FIG. 6. The slots 28 will accommodate any discharge such as gas or excess attachment material 17 as needed. The attachment material 17 quickly solidifies to attach the lens blank 5, the base 12 and optionally the ring member 22 together into an integral unit. In an alternative embodiment, the ring member 22 may be removed after the attachment. As discussed above, annular stop 34 is not provided in the embodiment where the ring member 22 is to be removed after attachment. The lens-shaped cavity 26 provides for nearly full contact of the attachment material 17 with the front surface of the edged lens blank 5 to be heated substantially equally, thereby alleviating the likelihood of thermal distortion of the edged lens blank 5. Distortion of the edged lens blank 5 must be avoided because no further edging of the lens is available. The concave mounting surface 24 substantially conforms to the shape of the lens blank 5. The concave inner portion of the first surface 13 conforms to the shape of the lens blank 5 and provides a substantially uniform thickness to the attachment material 17 in the cavity 26 which helps maintain even heating of the lens blank 5. In the embodiments shown in FIGS. 2 and 5, the planar outer portion of the first surface 13 abutting against the annular stop 34 provides a seal against the attachment material 17. A relatively tight fit between the outer surface of the base 12 and the annular wall 32 and between the drive studs 9 and recesses 14 also provides seals against the attachment material 17.

Following attachment of the properly aligned edged lens blank 5 to the lens block 10, the edged lens blank 5 will be surfaced to the appropriate curvature in a conventional fashion using techniques and machinery, such as a Coburn Model 108 generator, known in the art. As shown in FIG. 4, the dimensions and configurations of the bottom of the lens block 10 are designed to fit standard lens surfacing machinery. After the appropriate curvature is formed in the concave side of the edged lens blank 5, the lens is finished since it has been previously edged. The finished lens can be easily removed from the lens block 10 by heating the combined assembly past the melting temperature of the attachment material 17, which is generally conducted in a liquid bath. Other methods may be used for removal of the finished lens such as through a mechanical shock.

This construction allows for easy and proper blocking of an edged lens blank 5 and permits essentially distortion-free processing of the edged lens blank 5. This process and apparatus will have particular application to electro-optic lenses. With this process, edged lens blanks 5 requiring specific prescriptions to be generated therein can be produced using the lens block 10 of the present invention. The cavity 26 is specific to one lens or one frame shape. Consequently, separate lens blocks 10 will be required for separate lens shapes.

The illustrated embodiments are intended to be representative of the present invention and not restrictive thereof. It will be obvious to those of ordinary skill in the art that various modifications may be made to the present invention without departing from the spirit and scope thereof. Consequently, the scope of the present invention is intended to be defined by the appended claims.

What is claimed is:

1. A method for processing edged lenses comprising the steps of:

placing an edged lens blank on a ring member adjacent a lens-shaped cavity formed in said ring member, wherein said ring member surrounds a base;

rotating said edged lens blank and said ring member relative to said base to align said ring member and said base;

attaching said edged lens blank and said base; and surfacing said edged lens blank to form a finished lens.

2. The method of claim 1 wherein said attaching includes the steps of injecting an attaching material through said base into said lens-shaped cavity.

3. The method of claim 1 wherein said edged lens blank is an electro-optic lens and further including the step of removing said ring after said attachment of said lens blank and said base and prior to said surfacing of said edged lens blank.

4. A lens block for mounting a lens blank, said lens block comprising:

a substantially cylindrical base having a first surface facing the lens blank; and a ring member surrounding said base, said ring member having a mounting surface generally adjacent to the lens blank and a lens-shaped cavity surrounded by said mounting surface, said lens-shaped cavity generally adjacent to the lens blank, wherein said ring member is rotatable relative to said base prior to attachment of said base to the lens blank.

5. The lens block of claim 4 wherein said base includes a second surface opposed from said first surface and a plurality of driving recesses extending into said base from said second surface.

6. The lens block of claim 5 wherein said base includes a hole extending from said second surface to said first surface, said hole adapted to permit an attachment material to be injected therethrough to attach the lens blank to said base.

7. The lens block of claim 5 wherein three of said driving recesses are provided in said base and aligned along a diametrical line extending across said second surface.

8. The lens block of claim 7 wherein said lens block includes a hole extending from said second surface to said first surface, said hole adapted to permit an attachment material to be injected therethrough to attach the lens blank to said base.

9. The lens block of claim 8 wherein said mounting surface includes at least one slot that extends to a peripheral edge of said ring member.

10. The lens block of claim 9 wherein said ring member includes locating pins extending from said mounting surface.

11. The lens block of claim 10 wherein said ring member includes an annular wall opposed from said mounting surface, said annular wall surrounding said base.

12. The lens block of claim 11 wherein said ring member includes an annular stop adjacent said lens-shaped cavity, said annular stop abutting against said first surface.

13. The lens block of claim 4 wherein said mounting surface is substantially concave.

14. The lens block of claim 4 wherein said ring member includes a plurality of locating pins extending from said mounting surface.

15. The lens block of claim 4 wherein said mounting surface includes at least one slot therein and extending to a peripheral edge of said ring member.

16. The lens block of claim 4 wherein said ring member includes an annular wall opposed from said mounting surface, said annular wall surrounding said base.

17. The lens block of claim 4 wherein said ring member includes an annular stop abutting against said first surface.

18. A lens block for mounting a lens blank, said lens block comprising:

a substantially cylindrical base having a first surface facing the lens blank and a second surface opposed from said first surface, a plurality of driving recesses extending into said base from said second surface; and a ring member surrounding said base, said ring member having a mounting surface generally adjacent to the lens blank, wherein said ring member is rotatable relative to said base prior to attachment of said base to the lens blank.

19. The lens block of claim 18 wherein said base includes a hole extending from said second surface to said first surface, said hole adapted to permit an attachment material to be injected therethrough to attach the lens blank to said base.

20. The lens block of claim 18 wherein said ring member and said base define a lens-shaped cavity which is shaped substantially the same as the lens blank and dimensionally smaller than said lens blank.

* * * * *